US012304681B2

(12) United States Patent
Zhang et al.

(10) Patent No.: US 12,304,681 B2
(45) Date of Patent: May 20, 2025

(54) MELON PACKAGING MACHINE

(71) Applicant: HUAIBEI NORMAL UNIVERSITY, Huaibei (CN)

(72) Inventors: Huijun Zhang, Huaibei (CN); Yupeng Fan, Huaibei (CN); Li Jia, Huaibei (CN); Jian Ma, Huaibei (CN); Jingjing Wang, Huaibei (CN); Chun Liu, Huaibei (CN); Hu Li, Huaibei (CN); Zhongzhou Yang, Huaibei (CN); Zhugen Deng, Huaibei (CN)

(73) Assignee: HUAIBEI NORMAL UNIVERSITY, Huaibei (CN)

( * ) Notice: Subject to any disclaimer, the term of this patent is extended or adjusted under 35 U.S.C. 154(b) by 6 days.

(21) Appl. No.: 18/412,696

(22) Filed: Jan. 15, 2024

(65) Prior Publication Data

US 2024/0351727 A1 Oct. 24, 2024

Related U.S. Application Data

(63) Continuation of application No. PCT/CN2023/139652, filed on Dec. 18, 2023.

(30) Foreign Application Priority Data

Apr. 19, 2023 (CN) ..... 202310418194.6

(51) Int. Cl.

| | |
|---|---|
| ***B65B 59/00*** | (2006.01) |
| ***B65B 5/04*** | (2006.01) |
| ***B65B 35/24*** | (2006.01) |
| ***B65B 39/00*** | (2006.01) |
| ***B65B 43/26*** | (2006.01) |

(52) U.S. Cl.
CPC ..... *B65B 59/001* (2019.05); *B65B 5/045* (2013.01); *B65B 35/24* (2013.01); *B65B 39/00* (2013.01); *B65B 43/26* (2013.01); *B65B 2210/04* (2013.01)

(58) Field of Classification Search
CPC ..... B65B 59/001; B65B 5/045; B65B 39/00; B65B 43/26; B65B 2210/04
USPC ..... 53/384.1
See application file for complete search history.

(56) References Cited

U.S. PATENT DOCUMENTS 3,864,894 A * 2/1975 Sheetz ..... B65B 43/30 53/506
4,283,901 A * 8/1981 Schieser ..... B65B 43/60 53/284.7

* cited by examiner

*Primary Examiner* — Robert F Long
*Assistant Examiner* — Xavier A Madison
(74) *Attorney, Agent, or Firm* — Daniel M. Cohn

(57) ABSTRACT

A melon packaging machine is disclosed, relating to the technical field of fruit packaging. The machine includes a workbench and a controller. A rectangular through groove is provided in a middle of the workbench. A conveyor is provided on one side of the rectangular through groove. A melon outlet is provided between the conveyor and a wall of the rectangular through groove. A detecting mechanism is provided at a middle of the conveyor for detecting the shape of the melons. Two limiting parts are provided at a top of the workbench for guiding the melons horizontally. It can be realized by the machine that the melon can be packed with suitable packing bag which be automatically selected according to the size of the melon. The packing efficiency of the melon can be improved and the manpower consumption can be reduced.

10 Claims, 9 Drawing Sheets

MELON PACKAGING MACHINE

TECHNICAL FIELD

The present disclosure relates to the technical field of fruit packaging, and more specifically, to a melon packaging machine.

BACKGROUND ART

Melon, with heart-shaped leaves, unisexual, yellow, monoecious, or hermaphroditic flowers, is an annual trailing herb of the Cucurbitaceae family. The shape and color of melon vary according to the variety and are usually spherical or long ellipsoid.

In order to prevent dust from falling on the surface of the melons when they are placed, to ensure safe conveying and to conveniently carrying by the purchaser, the melons sold in supermarkets or fruit shops are generally packaged using bags.

After the melons are picked from the field by farmers, they are mostly packaged by hand. Due to the size of the melon is different, in order to prevent the rolling of the melons in the bag during conveying to damage the melons, and reduce packaging costs, choice of the right bag for its packaging is needed. In manual packaging, the sizes of the melons are generally observed through the eye of farmers, and then choose the right bag, which makes the manpower consumption is greater, packaging efficiency is lower and error rate is higher.

Therefore, a melon packaging machine is proposed to solve the above problems.

SUMMARY

Under the purpose, in the present disclosure, a melon packaging machine is provided to solve the above problems raised in the background technology.

In order to achieve the above purpose, the present disclosure provides the following technical solutions. A melon packaging machine includes a workbench and a controller. Wherein a rectangular through groove is provided in a middle of the workbench. A conveyor is provided on one side of the rectangular through groove. A melon outlet is provided between the conveyor and a wall of the rectangular through groove.

A detecting mechanism is provided at a middle of the conveyor for detecting the shape of the melons.

Two limiting parts are provided at a top of the workbench, guiding the melons horizontally to pass through the detecting mechanism for detection.

A guide part is provided at a bottom of the melon outlet. Wherein a melon falls through the melon outlet to a top of the guide part and rolls on the guide part.

A stationary disc is provided on one side of the workbench. Wherein a vertical shaft is rolling connected to a top of the stationary disc, and a connecting disc is fixed on a top rod of the vertical shaft.

A drive component is provided at a bottom of the vertical shaft to drive the vertical shaft to rotate.

A plurality of packing mechanisms are fixed to a disc body of the connecting disc to pack the melons.

Each of the packing mechanisms includes a fan-shaped plate and a fixing plate.

Each fan-shaped plate is provided with a through-hole on a plate body of the fan-shaped plate, and the through-hole on each fan-shaped plate have unequal inner diameters.

A plurality of locators are provided. Each locator is fixed at a top of corresponding fixing plate, electrically connected to the controller, locating the position of the fan-shaped plate and transmitting a positioning signal to the controller.

A bag opening component is provided at the bottom of the fan-shaped plate.

Preferably, the conveyor includes two rollers rolling connected with a wall of the rectangular through groove. Shafts of the rollers are connected with a conveyor belt. A first motor is fixed on one side of the workbench. An output end of the first motor is fixed with an end of one of the rollers.

Preferably, each limiting part includes a curved plate and a straight plate. A distance between inner sides of the two straight plates is greater than a maximum diameter of the melon.

Preferably, the detecting mechanism includes two L-shaped frames. A rotating shaft is rolling connected between the two L-shaped frames. A mounting plate is fixed to a shaft body of the rotating shaft, a charge coupled device (CCD) camera and a light emitting diode (LED) light are fixed to a bottom of the mounting plate. An angle adjustment component is provided on one side of the rotating shaft.

Preferably, the angle adjusting component includes a connecting plate. A worm is rolling connected to a plate body of the connecting plate, a worm gear is fixed on the shaft body of the rotating shaft. The worm gear is meshed with the worm, and a knob is fixed on a top of a rod body of the worm.

Preferably, the drive component includes a box, a live shaft is rolling connected between the box and the stationary disc. A second gear is fixed on a shaft body of the live shaft. A first gear is fixed on a shaft body of the vertical shaft. The first gear and the second gear are meshed, and a second motor is fixed at a top of the box. And an output end of the second motor is fixed to a top of the vertical shaft.

Preferably, the guide part includes a wide inclined plate and a narrow inclined plate, an outlet of the narrow inclined plate is provided at a top of the through-hole.

Preferably, each packaging mechanism further includes a curved baffle fixed to an outer side of the through-hole. The curved baffle is provided with a sponge plate fixed to an inner side of the curved baffle.

Preferably, the bag opening component includes a guide plate fixed to both sides of a bottom of the through-hole, an electric telescoping pole fixed to a bottom end of the fixing plate and an articulating plate. The telescopic end of the electric telescoping pole is fixed with a pushing head. A slider is slidably connected in the guide plate, a fixing shaft is fixed at a bottom end of the slider, a connecting shaft is fixed on both sides of the pushing head. One side of the articulating plate is movably connected to the connecting shaft and another side of the articulating plate is movably connected to the fixing shaft, and a curved supporting plate is fixed at the bottom end of the slider near a side of the through-hole.

Preferably, an anti-slip rubber plate is fixed on an outer side of the curved supporting plate.

Compared with the prior art, the beneficial effect of the present disclosure is as the follows.

The melon packaging machine is provided with a conveyor, a detecting mechanism, a drive component and a bag opening component. The size of the melons conveyed by the conveyor can be detected through the detecting mechanism. And then, the bag which is suitable for the melon rotates to the bottom of the guide part through the controlling of the controller so as to load the melon which falls through the guide part. It can be realized by the machine that the melon can be packed with suitable packing bag which be automatically selected according to the size of the melon. The packing efficiency of the melon can be improved and the manpower consumption can be reduced.

Figure 1:
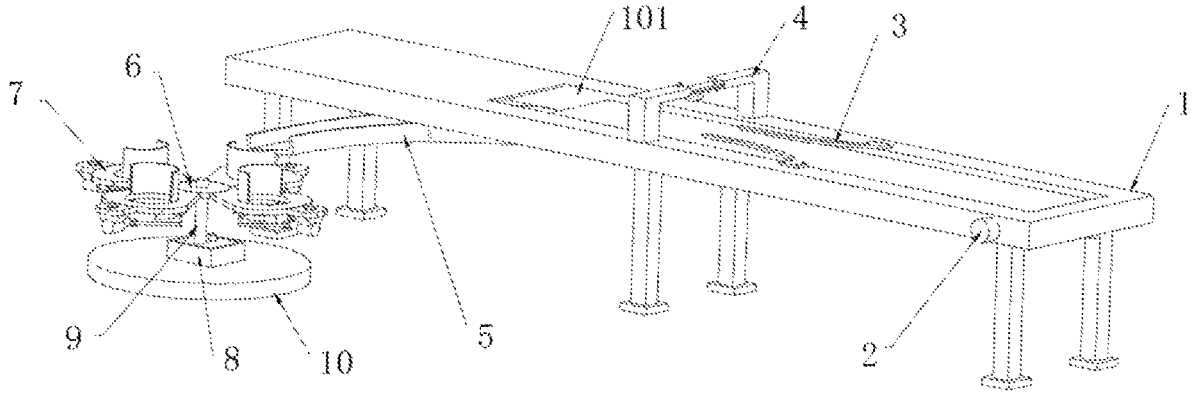
FIG. 1 is a schematic diagram of the overall structure of the present disclosure.

In the figures, 1 is the workbench, 101 is the melon outlet, 2 is the conveyor, 201 is the roller, 202 is the, 101 is the conveyor belt, 3 is the limiting part, 302 is the straight plate, 4 is the detecting mechanism, 401 is the L-shaped frame, 402 is the rotating shaft, 403 is the mounting plate, 404 is the CCD camera, 405 is the LED light, 406 is the connecting plate, 407 is the worm gear, 408 is the worm, 5 is the guide part, 501 is the wide inclined plate, 502 is the narrow inclined plate, 6 is the connecting disc, 7 is the packing mechanism, 701 is the fan-shaped plate, 702 is the through-hole, 703 is the curved baffle, 704 is the sponge plate, 705 is the fixing plate, 8 is the drive component, 801 is the box, 802 is the first gear, 803 is the live shaft, 804 is the second gear, 9 is the vertical shaft, 10 is the stationary disc, 11 is the locator, 12 is the bag opening component, 121 is the electric telescoping pole, 122 is the pushing head, 123 is the guide plate, 124 is the slider, 125 is the curved supporting plate, 126 is the fixing shaft, 127 is the articulating plate.

DETAILED DESCRIPTION OF THE EMBODIMENTS

The technical solutions in the embodiments of the present disclosure will be described clearly and thoroughly in combination with the attached drawings in the embodiments of the present disclosure. Obviously, the described embodiments are only a part of embodiments of the present disclosure and are not all of the embodiments. Based on the embodiments of the present disclosure, all of other embodiments obtained by those of ordinary skill in the art without inventive efforts belong to the protection scope of the present disclosure.

The present disclosure is suitable for packaging melons, and to solve the current technical problems of greater labor consumption, lower packaging efficiency and higher error rate when packaging manually. The present disclosure provides a technical solution with a melon packaging machine.

As shown in FIGS. 1-9, the machine includes a workbench 1 and a controller. Wherein a rectangular through groove is provided in a middle of the workbench 1. A conveyor 2 is provided on one side of the rectangular through groove. A melon outlet 101 is provided between the conveyor and a wall of the rectangular through groove. That is, the melon is conveyed through the conveyor 2 and then enters into the melon outlet 101.

A detecting mechanism 4 is provided at a middle of the conveyor 2 for detecting the shape of the melons. Two limiting parts 3 are provided at a top of the workbench 1, guiding the melons horizontally to pass through the detecting mechanism 4 for detection.

A guide part 5 is provided at a bottom of the melon outlet 101. As well known, a melon falls through the melon outlet 101 to a top of the guide part 5 and rolls on the guide part 5 under the effect of gravity.

A stationary disc 10 is provided on one side of the workbench 1. Wherein a vertical shaft 9 is rolling connected to a top of the stationary disc 10, and a connecting disc 6 is fixed on a top rod of the vertical shaft 9.

A drive component 8 is provided at a bottom of the vertical shaft 9 to drive the vertical shaft to rotate.

Four packing mechanisms 7 are fixed to a disc body of the connecting disc 6 to pack the melons. The packing mechanisms 7 are disposed equidistantly and in a circular pattern on the disc body of the connecting disc 6. As well known, the packing mechanism 7 is used to pack the melon. Each of the packing mechanisms 7 includes a fan-shaped plate 701 and a fixing plate 705.

Each fan-shaped plate 701 is provided with a through-hole 702 on the plate body of the fan-shaped plate 701, and the through-hole 702 on each fan-shaped plate 701 have unequal inner diameters so as to be adapted to open and fix different packaging bags.

A plurality of locators 11 are provided. Each locator 11 is fixed at a top of corresponding fixing plate 705, electrically connected to the controller, locating the position of the fan-shaped plate 701 and transmitting a positioning signal to the controller. This allows the controller to know the position of the corresponding packing mechanism 7 and facilitates accurate rotation of the packing mechanism 7.

A bag opening component 12 is provided at the bottom of the fan-shaped plate 701 for opening and securing the bags.

Figure 2:
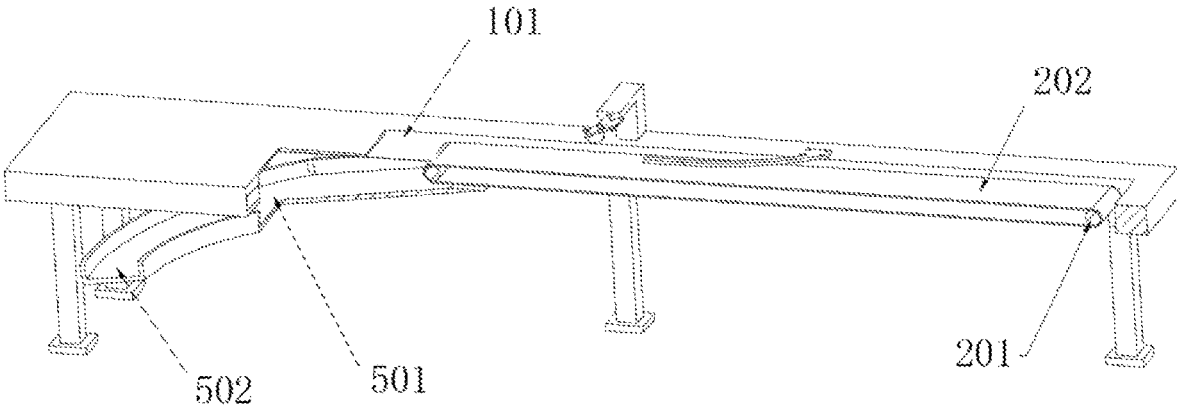
FIG. 2 is a semi-sectional diagram of the present disclosure.

In order to realize the convey of melons, as shown in FIGS. 1-2, the conveyor 2 includes two rollers 201 rolling connected with a wall of the rectangular through groove. Shafts of the rollers 201 are connected with a conveyor belt 202. A first motor is fixed on one side of the workbench 1. An output end of the first motor is fixed with an end of one of the rollers 201.

Specifically, during working, the first motor is controlled to rotate by the controller, and the first motor rotates to drive the rollers 201 to rotate. Thereby the rotation of the conveyor belt 202 can be realized. Convey of the melon placed on the conveyor belt 202 can be realized.

Figure 3:
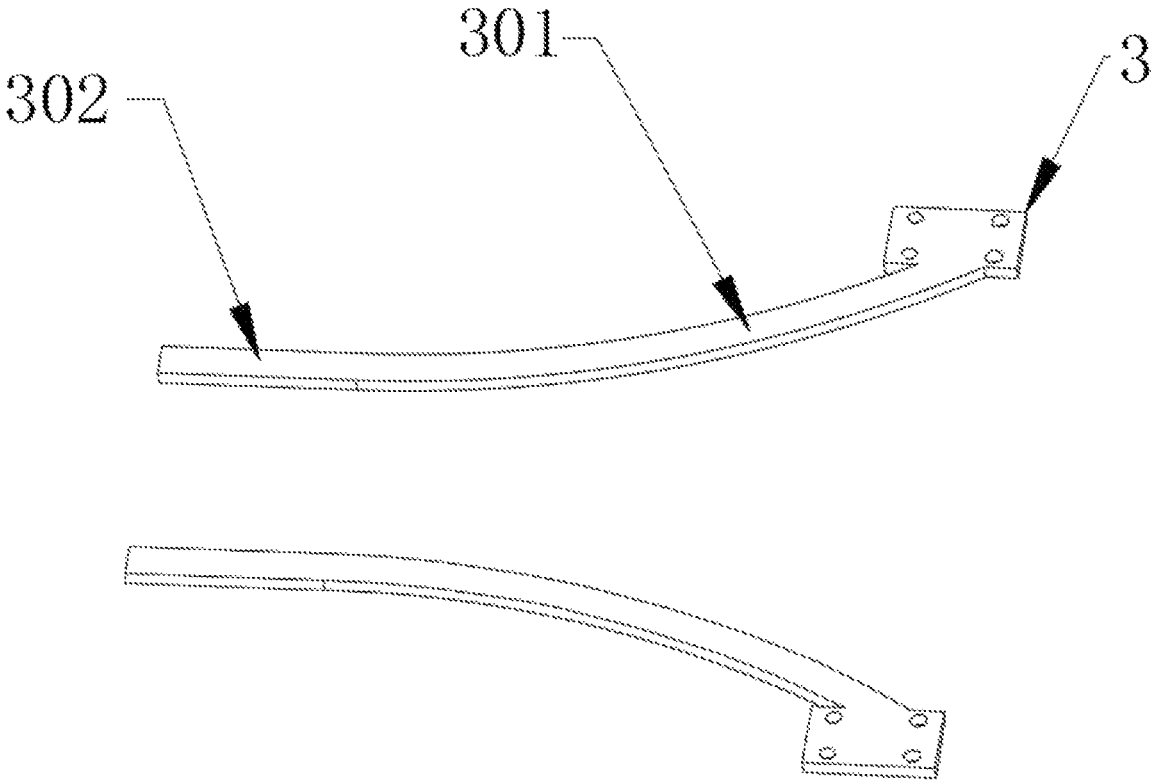
FIG. 3 is a detailed diagram of the limiting parts of the present disclosure.

In order to horizontal guiding of the melon passing through the detecting mechanism 4 for detection, as shown in FIG. 3, each limiting part 3 includes a curved plate 301 and a straight plate 302. As well known, the distance between inner sides of the two straight plates is greater than a maximum diameter of the melon to ensure that the largest diameter melons can pass through the gap formed by the two straight plates 302.

It is well known that due to the small difference in the size of the melons, in order to achieve this solution, the gap formed by the two straight plates 302 will not pass through the two melons side by side at the same time.

Figure 4:
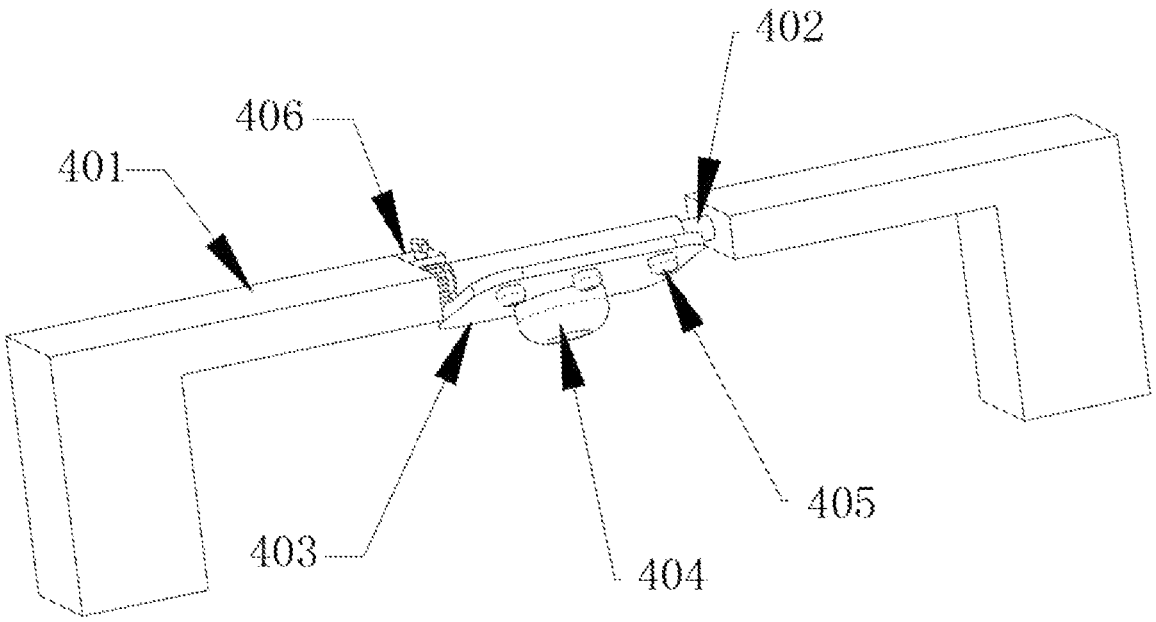
FIG. 4 is an axial view of the detecting mechanism of the present disclosure.
Figure 5:
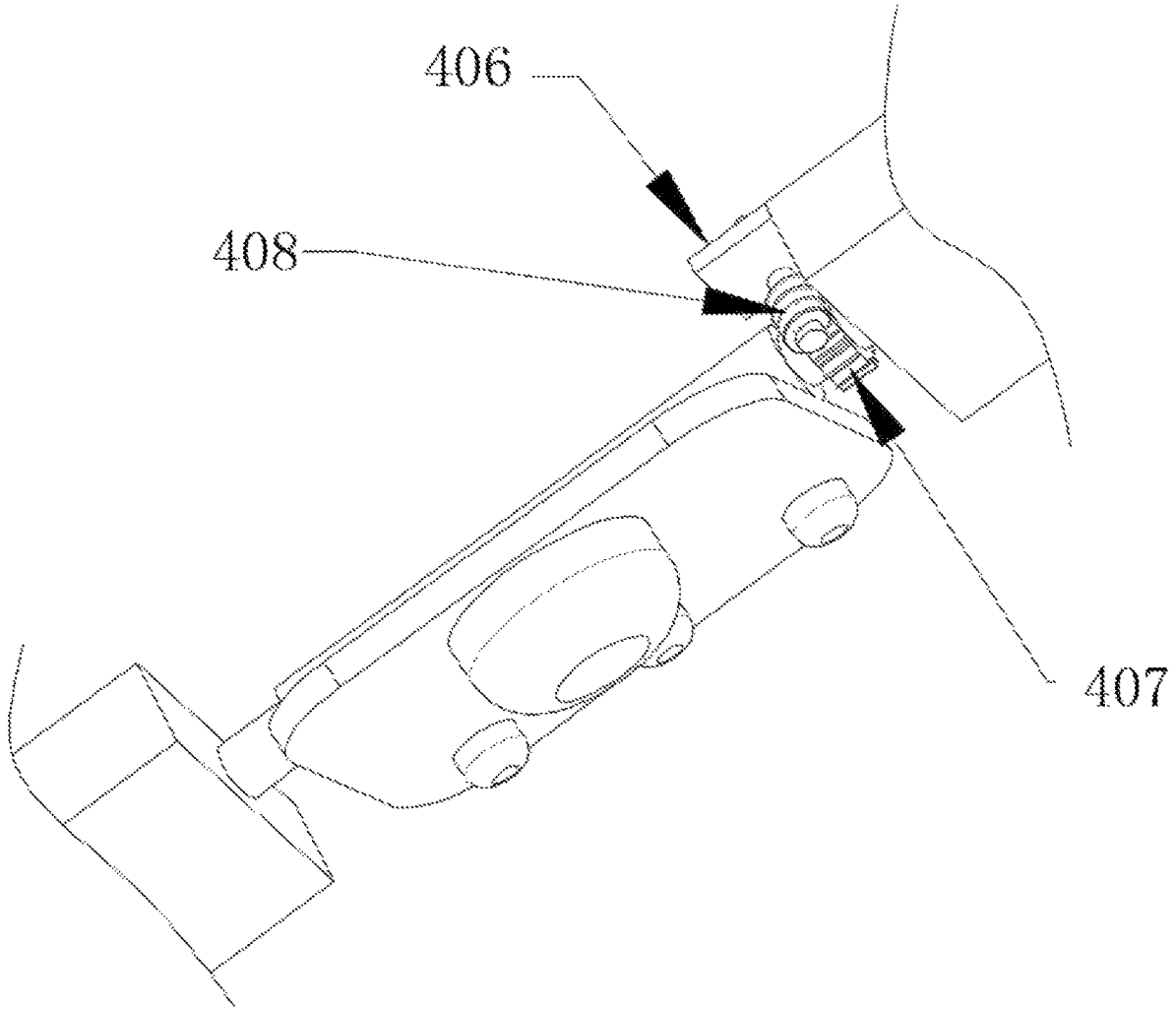
FIG. 5 is a vertical view of the detecting mechanism of the present disclosure.

In order to detect the shape and size of the melons and to select the suitable bag, as shown in FIGS. 4-5, the detecting mechanism 4 includes two L-shaped frames 401. A rotating shaft 402 is rolling connected between the two L-shaped frames 401. A mounting plate 403 is fixed to a shaft body of the rotating shaft 402, CCD camera 404 and an LED light 405 are fixed to a bottom of the mounting plate 403. An angle adjustment component is provided on one side of the rotating shaft 402.

The LED light 405 fills the CCD camera 404 with light to improve the shooting clarity of the CCD camera 404.

Before using, the CCD camera 404 should be angled so that it is in the optimum shooting position, as shown in FIG. 5, the angle adjusting component includes a connecting plate 406. A worm 408 is rolling connected to a plate body of the connecting plate 406, a worm gear 407 is fixed on the shaft body of the rotating shaft 402. The worm gear 407 is meshed with the worm 408, and a knob is fixed on a top of a rod body of the worm 408.

By turning the knob, the worm gear 408 can be rotated to achieve the rotation of the worm gear 407 and the rotating shaft 402. The angle adjustment of the mounting plate 403 can be realized. And further, the angle adjustment of the CCD camera 404, can be achieved. As well known, the angle adjustment component can also be realized by means of meshing gears. However, in order to ensure the stability of the rotating shaft 402 after rotating, a worm gear 407 and a worm 408 with self-locking properties are preferred in this solution.

Figure 7:
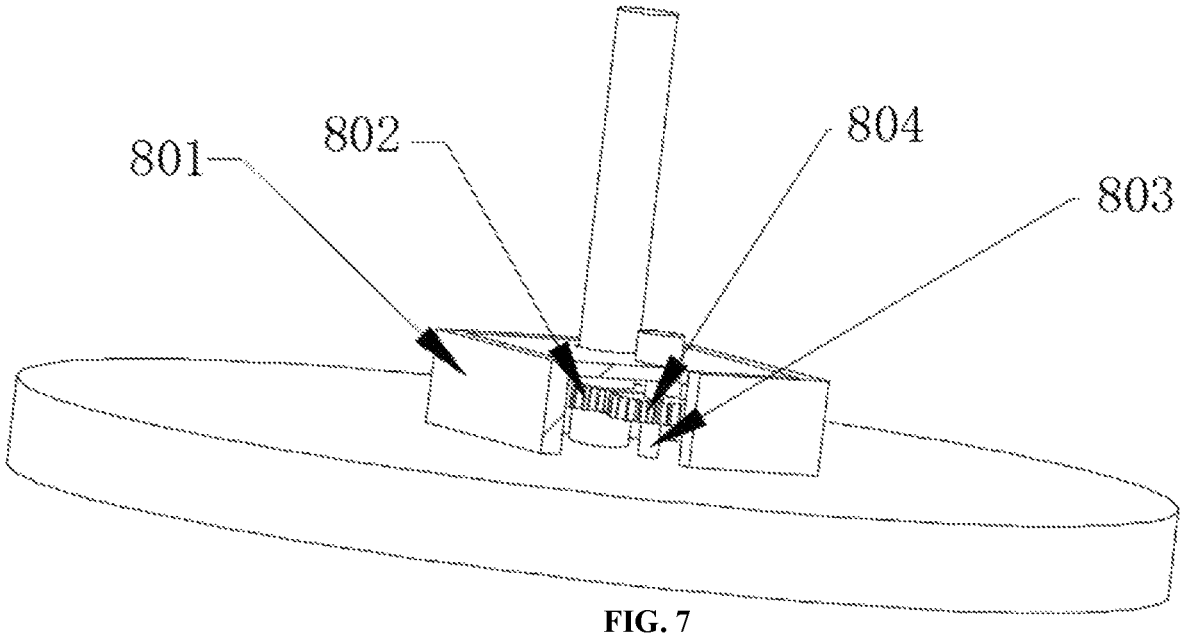
FIG. 7 is a semi-sectional view of the drive component of the present disclosure.

In order to realize the rotation of the vertical shaft 9, so as to move the suitable packaging bag to the outlet side of the guide part 5 to pack the melon, as shown in FIG. 7, the drive component 8 includes a box 801, a live shaft 803 is rolling connected between the box 801 and the stationary disc 10. A second gear 804 is fixed on a shaft body of the live shaft 803. A first gear 802 is fixed on a shaft body of the vertical shaft 9. The first gear 802 and the second gear 804 are meshed, and a second motor is fixed at a top of the box 801. And an output end of the second motor is fixed to a top of the vertical shaft 9. Similarly, the drive component 8 can also be realized by other alternatives, for example, by mounting a motor, differential, etc. at the bottom of the fixing disc 10 to achieve the rotation of the vertical shaft 9.

As shown in FIG. 2, as well known, the guide part 5 includes a wide inclined plate 501 and a narrow inclined plate 502, an outlet of the narrow inclined plate 502 is provided at a top of the through-hole 702.

Figure 6:
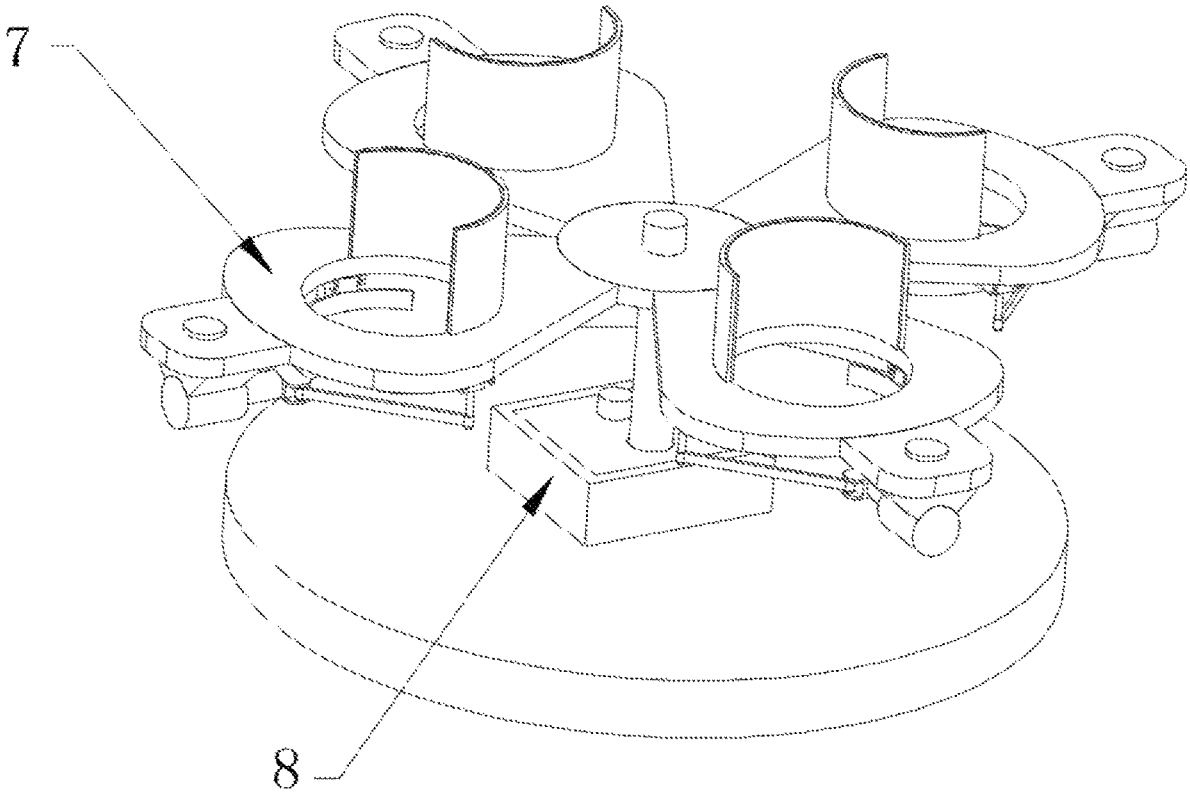
FIG. 6 is an axial view of the packaging mechanisms of the present disclosure.
Figure 8:
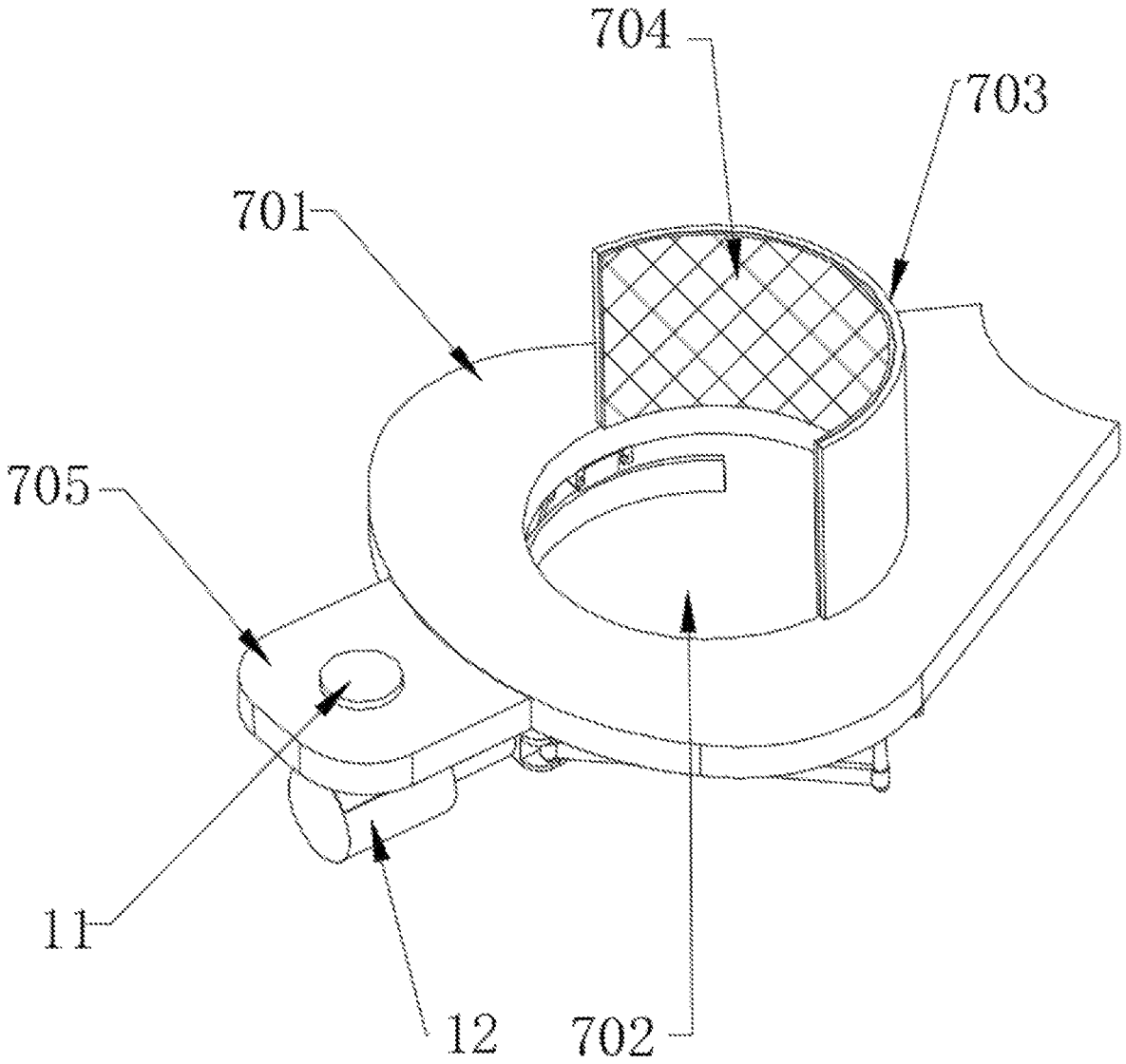
FIG. 8 is a detail diagram of the packaging mechanisms of the present disclosure.

In order to prevent the melons from entering into the through-hole 702, as shown in FIGS. 6-8, each packaging mechanism 7 further includes a curved baffle 703 fixed to an outer side of the through-hole 702. The curved baffle 703 is provided with a sponge plate 704 fixed to an inner side of the curved baffle 703.

Figure 9:
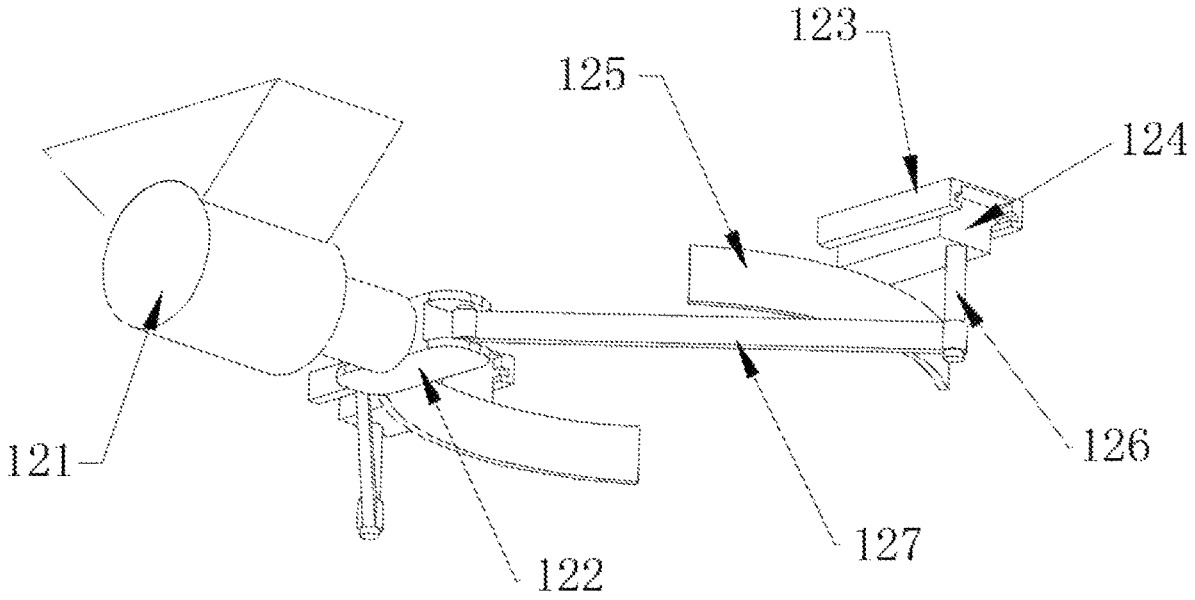
FIG. 9 is a vertical view of the bag opening component of the present disclosure.

In order to realize the opening of the packing bag and facilitate the entry of the melons into the packing bag, as shown in FIGS. 8-9, the bag opening component 12 includes a guide plate 123 fixed to both sides of a bottom of the through-hole 702, an electric telescoping pole 121 fixed to a bottom end of the fixing plate 705 and an articulating plate 127. The telescopic end of the electric telescoping pole 121 is fixed with a pushing head 122. A slider 124 is slidably connected in the guide plate 123 and fits into the rectangular through groove on the guide plate 123. A fixing shaft 126 is fixed at a bottom end of the slider 124, a connecting shaft is fixed on both sides of the pushing head 122. One side of the articulating plate 127 is movably connected to the connecting shaft and another side of the articulating plate 127 is movably connected to the fixing shaft 126, and a curved supporting plate 125 is fixed at the bottom end of the slider 124 near a side of the through-hole 702. The arc center of the curved supporting plate 125 coincides with the center of the through-hole 702.

In order to increase the friction between the curved supporting plate 125 and the packing bag, and prevent the melon from entering the packing bag and detaching from the packing bag under the gravity to cause damage to the melon, in the present disclosure, an anti-slip rubber plate is fixed on an outer side of the curved supporting plate 125.

For the supplement of the present disclosure, during working, the worker sets the corresponding mouth of the packaging bag on the outer side of the curved supporting plate 125, and then the controller controls the electric telescoping pole 121 to extend, and the two sliders 124 and the curved supporting plate 125 to move in a backward direction to open the mouth of the packaging bag, and realize the fixation of the packaging bag.

When the CCD camera 404 detects the size of the melons, the relevant size signal is sent to the controller. The controller determines the position of the packaging mechanisms 7 which fix bags with different sizes according to the locator 11. By the rotation control of the second motor, the corresponding fan-shaped plate 701 is rotated under the outlet of the guide part 5. After the melons falls into the packaging bag through the guide part 5, the controller to control the second motor to drive the packaging bag containing the melon to the position of the worker. And after the worker holds the packaging bag, the controller controls the electric telescoping pole 121 to retract, thereby lifting the restriction on the packaging bag by the curved supporting plate 125. Finally, the worker sets the mouth of the corresponding packaging bag to the outer side of the curved supporting plate 125 again, and repeats the above steps to realize the installation and fixation of the packaging bag.

Although embodiments of the present disclosure have been shown and described, it will be understood by those skilled in the art that various changes, modifications, substitutions and alterations can be made hereto without departing from the spirit and scope of the disclosure as defined by the appended embodiments and equivalents thereof.

What is claimed is:

1. A melon packaging machine, comprising:

a workbench and a controller, wherein a rectangular through groove is provided in a middle of the workbench, a conveyor is provided on one side of the rectangular through groove, a melon outlet is provided between the conveyor and a wall of the rectangular through groove;

a detecting mechanism, provided at a middle of the conveyor, detecting shape of melons;

two limiting parts, provided at a top of the workbench, guiding the melons horizontally to pass through the detecting mechanism for detection;

a guide part, provided at a bottom of the melon outlet, wherein a melon falls through the melon outlet to a top of the guide part and rolls on the guide part;

a stationary disc, provided on one side of the workbench, wherein a vertical shaft is rolling connected to a top of the stationary disc, and a connecting disc is fixed on a top rod of the vertical shaft;

a drive component, provided at a bottom of the vertical shaft to drive the vertical shaft to rotate;

a plurality of packing mechanisms, fixed to a disc body of the connecting disc to pack the melons, wherein each of the packing mechanisms comprises a fan-shaped plate and a fixing plate, each fan-shaped plate is provided with a through-hole on a plate body of the fan-shaped plate, and the through-hole on each fan-shaped plate have unequal inner diameters;

a plurality of locators, each locator fixed at a top of corresponding fixing plate, electrically connected to the controller, locating the position of the fan-shaped plate and transmitting a positioning signal to the controller; and a bag opening component, provided at the bottom of the fan-shaped plate.

2. The melon packaging machine of claim 1, wherein the conveyor comprises two rollers rolling connected with a wall of the rectangular through groove, shafts of the rollers are connected with a conveyor belt, a first motor is fixed on one side of the workbench, an output end of the first motor is fixed with an end of one of the rollers.

3. The melon packaging machine of claim 1, wherein each limiting part comprises a curved plate and a straight plate, a distance between inner sides of the two straight plates is greater than a maximum diameter of the melon.

4. The melon packaging machine of claim 1, wherein the detecting mechanism comprises two L-shaped frames, a rotating shaft is rolling connected between the two L-shaped frames, a mounting plate is fixed to a shaft body of the rotating shaft, a charge coupled device (CCD) camera and a light emitting diode (LED) light are fixed to a bottom of the mounting plate, an angle adjustment component is provided on one side of the rotating shaft.

5. The melon packaging machine of claim 4, wherein the angle adjusting component comprises a connecting plate, a worm is rolling connected to a plate body of the connecting plate, a worm gear is fixed on the shaft body of the rotating shaft, the worm gear is meshed with the worm, and a knob is fixed on a top of a rod body of the worm.

6. The melon packaging machine of claim 1, wherein the drive component comprises a box, a live shaft is rolling connected between the box and the stationary disc, a second gear is fixed on a shaft body of the live shaft, a first gear is fixed on a shaft body of the vertical shaft, the first gear and the second gear are meshed, and a second motor is fixed at a top of the box, and an output end of the second motor is fixed to a top of the vertical shaft.

7. The melon packaging machine of claim 1, wherein the guide part comprises a wide inclined plate and a narrow inclined plate, an outlet of the narrow inclined plate is provided at a top of the through-hole.

8. The melon packaging machine of claim 1, wherein each packaging mechanism further comprises a curved baffle fixed to an outer side of the through-hole, the curved baffle is provided with a sponge plate fixed to an inner side of the curved baffle.

9. The melon packaging machine of claim 1, wherein the bag opening component comprises a guide plate fixed to both sides of a bottom of the through-hole, an electric telescoping pole fixed to a bottom end of the fixing plate and an articulating plate, the telescopic end of the electric telescoping pole is fixed with a pushing head, a slider is slidably connected in the guide plate, a fixing shaft is fixed at a bottom end of the slider, a connecting shaft is fixed on both sides of the pushing head, one side of the articulating plate is movably connected to the connecting shaft and another side of the articulating plate is movably connected to the fixing shaft, and a curved supporting plate is fixed at the bottom end of the slider near a side of the through-hole.

10. The melon packaging machine of claim 9, wherein an anti-slip rubber plate is fixed on an outer side of the curved supporting plate.

* * * * *